US005092215A

United States Patent [19]

Mello et al.

[11] Patent Number: 5,092,215

[45] Date of Patent: Mar. 3, 1992

[54] GUITAR BOW

[76] Inventors: William Mello, 10 Winter St., New Bedford, Mass. 02740; John Hendrickson, 158 Norton Ave., S. Easton, Mass. 02375

[21] Appl. No.: 633,933

[22] Filed: Dec. 26, 1990

[51] Int. Cl.[5] ..... G10D 3/16

[52] U.S. Cl. ..... 84/325

[58] Field of Search ..... 84/319, 322, 325

[56] References Cited

U.S. PATENT DOCUMENTS

| | | | |
|---|---|---|---|
| 1,241,370 | 9/1917 | Griffin | 84/325 |
| 3,457,822 | 7/1969 | Mull | 84/319 |
| 4,253,372 | 3/1981 | Filipetti | 84/322 |
| 4,817,488 | 4/1989 | Santos | 84/319 |

*Primary Examiner*—Brian W. Brown

*Attorney, Agent, or Firm*—Barlow & Barlow, Ltd.

[57] ABSTRACT

Guitar bow having horse hair strands applied to a cylindrical surface for engagement with one string only of a flat string array, and having a holding portion to facilitate bowing.

5 Claims, 2 Drawing Sheets

GUITAR BOW

BACKGROUND OF INVENTION

In the manufacture and use of stringed musical instruments, there are two classes: fretted and unfretted. Among the unfretted instruments, the violin family can be played by placing the finger on a string and pressing it against the surface of the neck. The strings in such instruments can be arranged to define a curved surface. This makes it possible to play the violin and its family of instruments with a straight bow. Because the strings are in an arch, the bow can contact one string at a time.

In the case of the fretted instruments, such as the guitar, the strings are pressed against straight frets that extend transversely of the neck of the instrument. This arrangement requires that the strings lie side-by-side to define a flat surface. Although it has been suggested that a guitar would give an interesting tone if bowed in the manner of a violin, it is impossible to draw a conventional bow across a single string. This is because the strings all lie in a single plane and there has been no way to bow a single string in an instrument of that type.

In the past, various types of bows for stringed instruments have been proposed. For instance, in the patent of KRAUSE No. 2,421,567, a violin bow has been shown in which it is possible to vary the tension of the horse hair element to allow the playing of more than one string at a time. The patent of RICHTER No. 1,258,463 describes a motor-driven cylinder on which horse hair is wound.

The patent of LUKEHART No. 4,867,032 illustrates the general nature of a pick that is moutned ont eh thumb. The patent of ATTWOOD No. 2,466,834 shows the support structure of a violin bow, using a tube which is filled with a sound-absorbent material. The German patent of HLUBEK No. 500,031 shows a violin bow in which the horse hairs are wound around a cyclindrical winch at each end. None of these devices could be used as a plectrum or pick to play an instrument having a flat array of strings. These and other difficulties experienced with the prior art devices have been obviated in a novel manner by the present invention.

It is, therefore, an outstanding object of the invention to provide a guitar bow that can be used to actuate a single string in a flat array of strings by bowing.

Another object of this invention is the provision of a guitar bow that can be used in the manner of a conventional plectrum or pick.

A further object of the present invention is the provision of a guitar bow which is simple and rugged in construction, which can be readily and inexpensively manufactured, and which is capable of a long life of useful service.

A still further object of the invention is the provision of a guitar pick which can be used to provide an unusual tone on the instrument.

It is a further object of the invention to provide a guitar device that can be used selectively to pick or to bow a single string.

With these and other objects in view, as will be apparent to those skilled in the art, the invention resides in the combination of parts set forth in the specification and covered by the claims appended hereto.

SUMMARY OF THE INVENTION

In general, the invention consists of a guitar bow having a main body formed to provide a holding portion and a contact portion. The contact portion has a cylindrical surface facing away from the holding portion and covered with a layer of friction material.

More specifically, the layer of friction material consists of horse hair strands laid circumferentially of the cylindrical surface. A layer of resilient material is interposed between the layer of friction material and the cylindrical surface. The cylindrical surface is formed with a radius of curvature, such as to allow contact of the layer of friction material with a single string of a guitar without contacting the adjacent strings.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
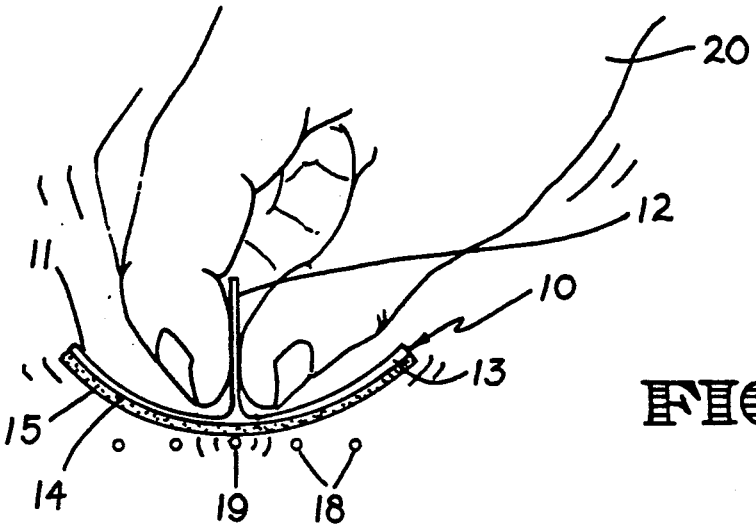
FIG. 1 is a front elevational view of a guitar bow incorporating the principles of the present invention, and shown in use with a guitar.

Referring first to FIG. 1, which best shows the general features of the invention, the guitar bow, indicated generally by the reference numeral 10, is shown in use by a guitarist 20 on a guitar having strings 18. The guitar bow has a main body 11 having a holding portion 12 and a contact portion 13. The contact portion has a cylindrical surface 14 which faces away from the side on which the holding portion 12 is located. A layer 15 of friction material overlies the said cylindrical surface.

FIGS. 1-4 show further details of construction, including the fact that the layer of friction material consists of natural or synthetic horse hair strands 16 laid circumferentially of the cylindrical surface. A layer 17 of a resilient substance is located between the layer of friction material and the cylindrical surface. In the preferred embodiment, this resilient material is an elastomer, such as rubber foam or a polymer, such as a closed-cell polyvinyl chloride in the form of a tape.

The radius of curvature of the cylindrical surface 14 (and, therefore, of the layer 15 of frictional material) is selected to allow contact of the outer surface of the layer of frictional material to engage one string 19 of a guitar without contacting the adjacent strings.

Figure 2:
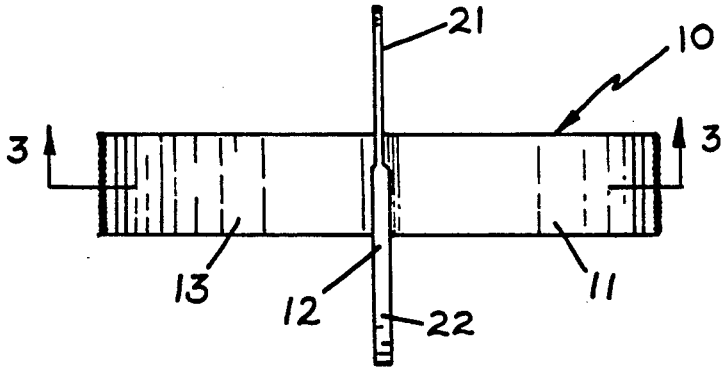
FIG. 2 is a plan view of the guitar bow.
Figure 3:
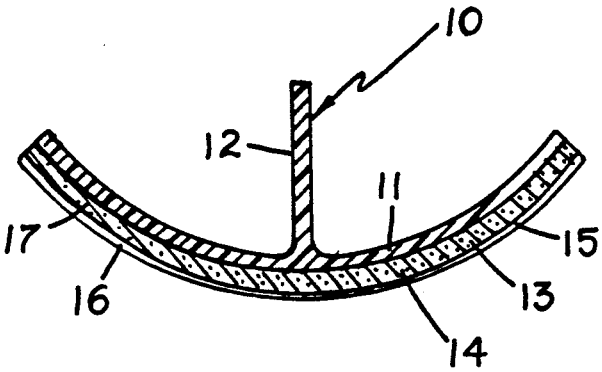
FIG. 3 is a vertical sectional view of the guitar bow, taken on the line 3—3 of FIG. 2.
Figure 4:
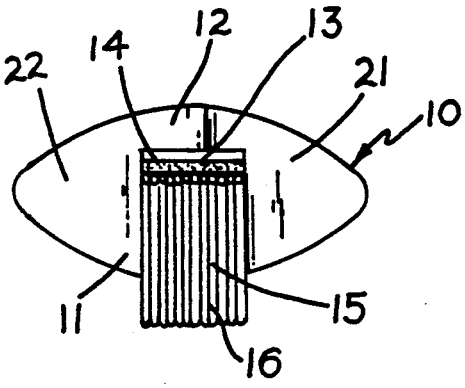
FIG. 4 is a right hand side elevational view of the guitar bow.

As is evident in FIG. 2, the holding portion 12 is a web that extends from the center of the contact portion 13 in a manner that is parallel to the generatrices of the cylindrical surface 14. The web is in the form of a guitar pick. Furthermore, the web is shaped to present a thin pick 21 in one direction and a thick pick 22 is the other direction. Both picks extend beyond the edges of the contact portion 13.

The operation and advantages of the present invention will now be readily understood in view of the above description. The holding portion 12 of the guitar bow 10 is held between the thumb and forefinger of the strumming or picking hand of the guitarist 20. This is best shown in FIG. 1, where it is evident that the outer surface of the layer 16 of horse hair (to which rosin has been applied) engages the string 19 and none of the other strings 18. A lateral movement of the bow 10, combined with a degree of rotation, will produce a continuous vibratory tone from the string, similar to that of the violin or cello. It can be used on all types of guitars, including 6- and 12-string acoustical and electric guitars, to produce unusual and novel sounds for these instruments, which sounds are different from the tone usually obtained by plucking or picking the string.

Figure 5:
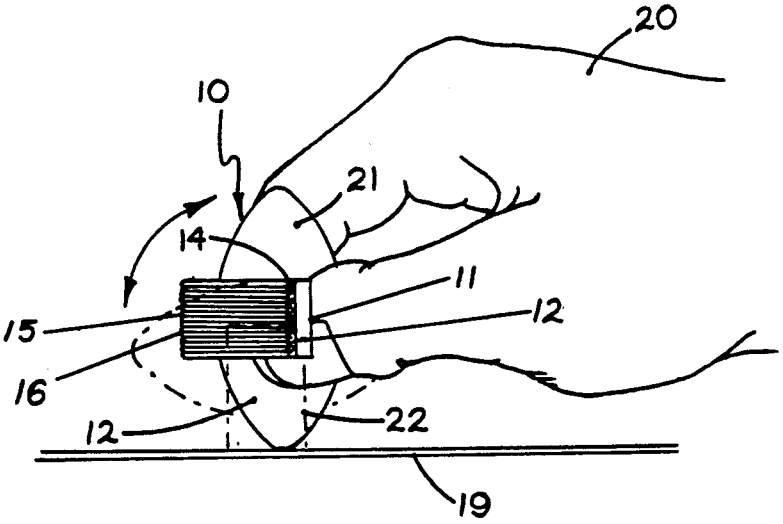
FIG. 5 is a side view of the guitar bow, showing it in use with a guitar.

By rotating the bow, as indicated in FIG. 5, it is possible to bring a pick into playing position. This can be done quickly and provides a selection which can alternate from a bow sound to a pick sound.

Figure 6:
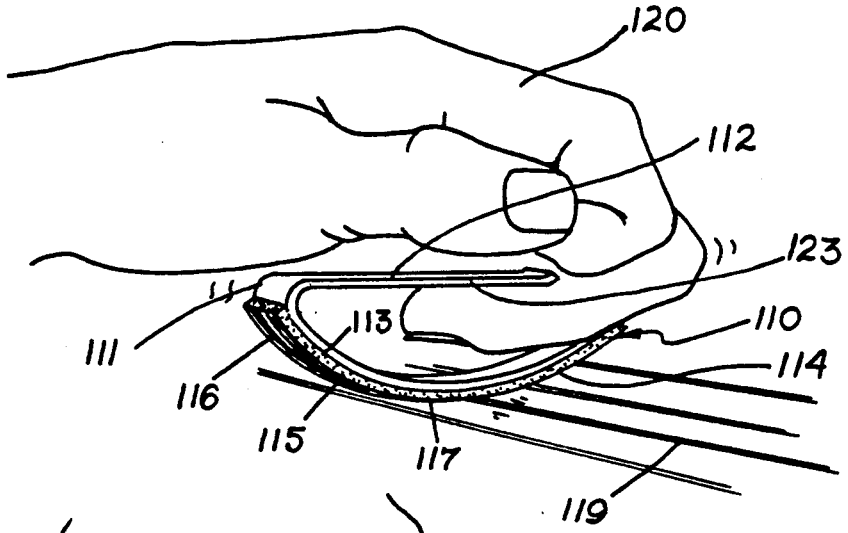
FIG. 6 is a perspective view of a modification of the guitar bow.

FIG. 6 shows a modified form of the invention in which the guitar bow 110 is shown as having a main body 111 which consists of a holding portion 112 and a contact portion 113. The contact portion has a cylindrical surface 114 facing away from the holding portion. A layer 115 of friction material consisting of horse hair strands overlies the cylindrical surface and rests on a layer 117 of resilient foam. Here again, the radius of curvature of the cylindrical surface 114 and the layers overlying it is such as to allow contact with a single string 119 of a flat array of guitar strings. In this case, the holding portion 112 is integral with one end only of the contact portion 113. It consists of a flat web which overlies the contact portion, in the manner of the secant of an arc. It is evident in the drawing that the gap between the free end of the holding portion 112 and the free end of the contact portion 113 is sufficient to receive the guitarist's middle finger and to clamp it. The action of this variation of the invention is similar to the previously-described version, i.e., a lateral bowing of the string 119 produces the unusual sound in the guitar.

Figure 7:
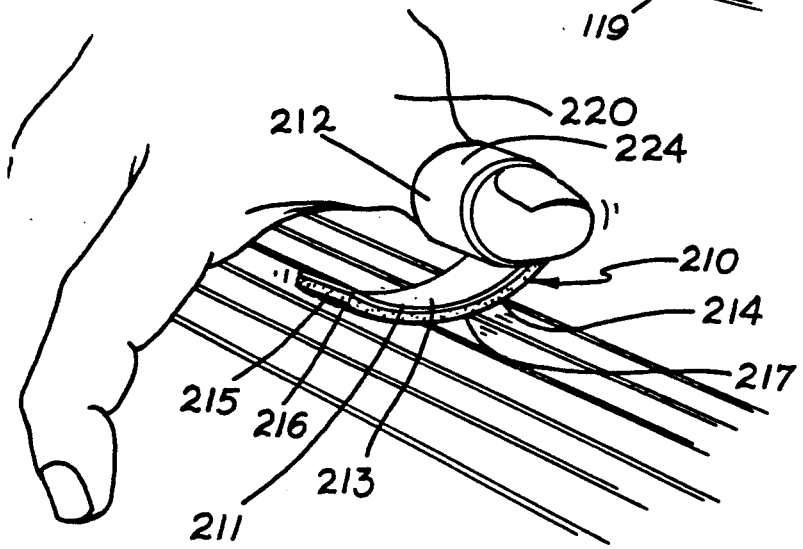
FIG. 7 is a perspective view of another modified form of the guitar bow.

FIG. 7 shows another variation of the invention, consisting of a guitar bow 210 having a main body 211 which is form with a holding portion 212 attached to a contact portion 213 whose cylindrical surface 214 is provided with a layer 215 of friction material. The friction material is composed of horse hair strands 216 laid over a layer 217 of resilient foam tape which, in turn; is laid over the cylindrical surface of the contact portion. The curvature of the contact portion is selected to allow contact of the horse hair strands with a single guitar string and to allow lateral bowing of the string to produce a distinctive tone. As is evident in the drawing, the holding portion 212 is integrally formed on one end of the contact portion 213 and is in the shape of a tubular thumb clip 224. This allows the bow to be carried by the thumb of the guitarist 220 and to be used in a lateral bowing movement.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Guitar bow, comprising (a) a main body having a holding portion and having an elongated contact portion with a cylindrical surface facing away from the holding portion, (b) a layer of frictional material overlying the said cylindrical surface, wherein the radius of curvature of the cylindrical surface is selected to allow contact of the layer of frictional material to engage one string of a guitar without contacting the adjacent strings, wherein the layer of frictional material consists of horse strands laid circumferentially of the cylindrical surface, and (c) a layer of elastomeric substance located between the layer of frictional material and the said cylindrical surface to provide a barrier layer between the strands and the contact portion.

2. Guitar bow as recited in claim 1, wherein the holding portion is a web extending from the center of the contact portion, extending parallel to the axis of cylindrical surface, and wherein the web acts as a pick.

3. Guitar bow comprising a main body having a holding portion and an elongated contact portion, said elongated contact portion defining an arcuate portion of a cylindrical surface, said holding portion being integral with one end only of the contact portion and consisting of a flat web overlying the contact portion in the form of a secant to the cylindrical surface to provide a gap at the free end of the web for the reception of a finger, a layer of strands laid circumferentially of the cylindrical surface and a layer of an elastomeric substance located between the layer of strands and the said cylindrical surface to provide a barrier layer between the strands and the contact portion.

4. Guitar bow as recited in claim 1, wherein the holding portion is integral with one end of the contact portion and is formed as a tubular thumb clip.

5. Guitar bow as recited in claim 2, wherein the web is shaped to present a thin pick in one direction and a thick pick in the other direction both picks extending beyond the side edges of the contact portion.

* * * * *